US006098217A

United States Patent [19]

Hammil

[11] Patent Number: 6,098,217

[45] Date of Patent: Aug. 8, 2000

[54] MODULAR PLAYPEN

[76] Inventor: Mark A. Hammil, 5394 Holiday Pl., Margate, Fla. 33063

[21] Appl. No.: 09/258,720

[22] Filed: Feb. 26, 1999

[51] Int. Cl.[7] ..... A47D 7/00

[52] U.S. Cl. ..... 5/93.1; 5/93.2; 5/97

[58] Field of Search ..... 5/93.1, 93.2, 100, 5/2.1, 97, 98.2; 256/1, 25; 119/509, 502, 416; 135/87

[56] References Cited

U.S. PATENT DOCUMENTS

| | | | |
|---|---|---|---|
| D. 365,932 | 1/1996 | Reynolds et al. . | |
| 3,770,246 | 11/1973 | Key . | |
| 3,824,813 | 7/1974 | Cooper . | |
| 5,081,723 | 1/1992 | Saunders | 5/100 |
| 5,544,870 | 8/1996 | Kelley et al. . | |
| 5,595,230 | 1/1997 | Guerra . | |
| 5,787,524 | 8/1998 | Butnik | 5/93.1 |

*Primary Examiner*—Terry Lee Melius
*Assistant Examiner*—Fredrick Conley
*Attorney, Agent, or Firm*—Malin, Haley & DiMaggio, P.A.

[57] ABSTRACT

A modular playpen for infants and young children comprising five basic parts including a plurality of substantially rectangular side panels; a plurality of vertical uprights slidably affixed to each end of a side panel via a longitudinal groove running the length of each vertical upright, thereby forming an enclosure; floor pads positioned within the enclosure; a series of horizontal cross bars removably engaged to the lower portion of each vertical upright thereby providing support to the playpen; and a central post positioned beneath the floor pads to provide additional support to the floor pads. The modular playpen can be reconfigured in a variety of shapes to conform to space constraints, and can be assembled, disassembled and reassembled again quickly without the use of tools.

12 Claims, 6 Drawing Sheets

MODULAR PLAYPEN

BACKGROUND OF THE INVENTION

1. Field of the Invention

The present invention relates to a ready-to-assemble playpen for use by infants and young children and more specifically to a modular playpen with interchangeable components adaptable to fit any available shape or space by adding or removing components without the use of tools.

2. Description of Related Art

The use of playpen enclosures are well known. Whether at home, child-care centers, hospitals, or outdoors, playpens provide safety, mobility and entertainment for infants, toddlers and small children.

The typical playpens are square, rectangular, or circular in shape, and are high enough to prevent the child from climbing out of the interior of the playpen. Most playpens are comprised of netting allowing the occupant to observe the goings-on outside the confines of the playpen, and solidly-connected side walls. While these playpens serve their purpose of confining the child, the shape of the outer perimeter of the playpen is fixed and cannot be altered, or can only be done so with a significant amount of physical effort. Other types of playpens have removable components, but the components are different, and not interchangeable, therefore severely limiting the possible configurations. This creates significant problems when attempting to quickly assemble and re-assemble the playpen or to fit the playpen into areas limited by space constraints. If a family moves, goes on vacation, or visits friends, the playpen, due to its rigid structure, may not fit into another, differently-shaped room.

U.S. Pat. No. 5,081,723 issued to Saunders discloses a playpen with detachable sides to be used as security gates. Sides of the playpen can be removed and secured to the frame of a door. Although the invention in Saunders discloses removable sides, it fails to disclose a playpen with interchangeable components. Further, it fails to disclose floor pads which, supported by horizontal cross bars underneath the floor pads, form the base of the enclosure. Because the components in the modular playpen of the present invention are standard, in particular the side panels, the vertical uprights, and the cross bars, the playpen can be easily reconfigured to conform to differently-shaped rooms or spaces.

U.S. Pat. No. 5,544,870 issued to Kelley et al. discloses a play enclosure apparatus which includes a plurality of panels that are connected at their sides to form a play enclosure. In Kelley, each side panel has a first connector portion on one side and a second connector portion on its other side. This allows for any first connector portion to be releasably connected to another second connector portion on any other side panel. However, unlike the modular playpen of the present invention, the ability to reconfigure the enclosure in Kelley is limited. Because of its two different types of connector portions, not every side panel in Kelley can be connected to every other side panel in the same fashion. This severely limits its adaptability. One using the modular playpen with its standard groove-side panel connections, can removably connect each side panel to one of a plurality of grooves in any of the vertical uprights, thereby creating a myriad of configurations.

BRIEF SUMMARY OF THE INVENTION

The present invention relates to a modular playpen comprising a plurality of vertical uprights, each having a central longitudinal portion, a plurality of substantially rectangular side panels, each having opposing horizontal and vertical sides slidably affixed to the vertical uprights via affixing means thereby forming an enclosure of sufficient size to accommodate a child, a plurality of cross bars positioned horizontally between the vertical uprights wherein each end of the cross bar is removably engaged with one of the vertical uprights to provide stability to the modular playpen and one or more floor pads positioned within the interior of the enclosure and supported therein by supporting means, whereby said playpen is sufficiently sturdy to safely protect a child therein and can be reconfigured to a variety of different shapes to accommodate space constraints, without the use of tools or excess effort.

In an alternate embodiment of the present invention each cross bar comprises a flat upper longitudinal surface, a rounded lower longitudinal surface and a transverse divider extending tangentially from the flat upper longitudinal surface and bisecting the flat longitudinal surface thereby creating an inner and outer flat upper longitudinal surface.

In an alternate version, the affixing means comprises a groove extending down the central longitudinal portion of the vertical upright to receive a vertical side of a side panel.

An alternate embodiment of the present invention provides that the vertical upright has a plurality of grooves extending down its central longitudinal portion allowing for removable engagement with the side panels, thereby allowing said playpen to be reconfigured in a variety of ways.

In yet an another embodiment, the supporting means comprises a ledge created by the intersection of the transverse divider and the inner flat upper longitudinal surface such that the ledge provides lateral support for the floor pads.

In an alternate embodiment, a center support post is positioned substantially underneath the floor pads and is secured therein by engagement to a plurality of cross bars thereby providing additional stability to the modular playpen and raising the floor pads off the ground.

In an alternate embodiment of the present invention, the floor pads comprise cut-outs on each of its corners wherein the center post protrudes through the cut-outs thereby providing a flush, contiguous interface between the floor pad and the vertical upright.

An alternate embodiment of the present invention provides for the cross bar to be inserted into said vertical upright below the groove in the vertical upright.

In another embodiment, each side panel is identical to each other side panel thereby allowing for interchangeability of side panels; each vertical upright is identical to each other vertical upright thereby allowing for interchangeability of vertical uprights; and each cross bar is identical to each other cross bar thereby allowing for interchangeability of cross bars.

It is an object of this invention to provide a modular playpen which can be assembled, disassembled and reassembled again without difficulty and without the use of tools to allow for the playpen to be moved to a different room, outdoors, or to another location entirely.

It is another object of this invention to provide a modular playpen that can be reassembled in various shapes and configurations to allow for easy adaptability to different rooms with different spacial constraints.

It is yet another object of this invention to provide a modular playpen that can be expanded and altered quickly and easily by adding components parts.

It is yet another object of this invention to provide a modular playpen with standard parts, therefore allowing for quick replacement of parts.

In accordance with these and other objects which will become apparent hereinafter, the instant invention will now be described with particular reference to the accompanying drawings.

DETAILED DESCRIPTION OF THE INVENTION

Figure 1:
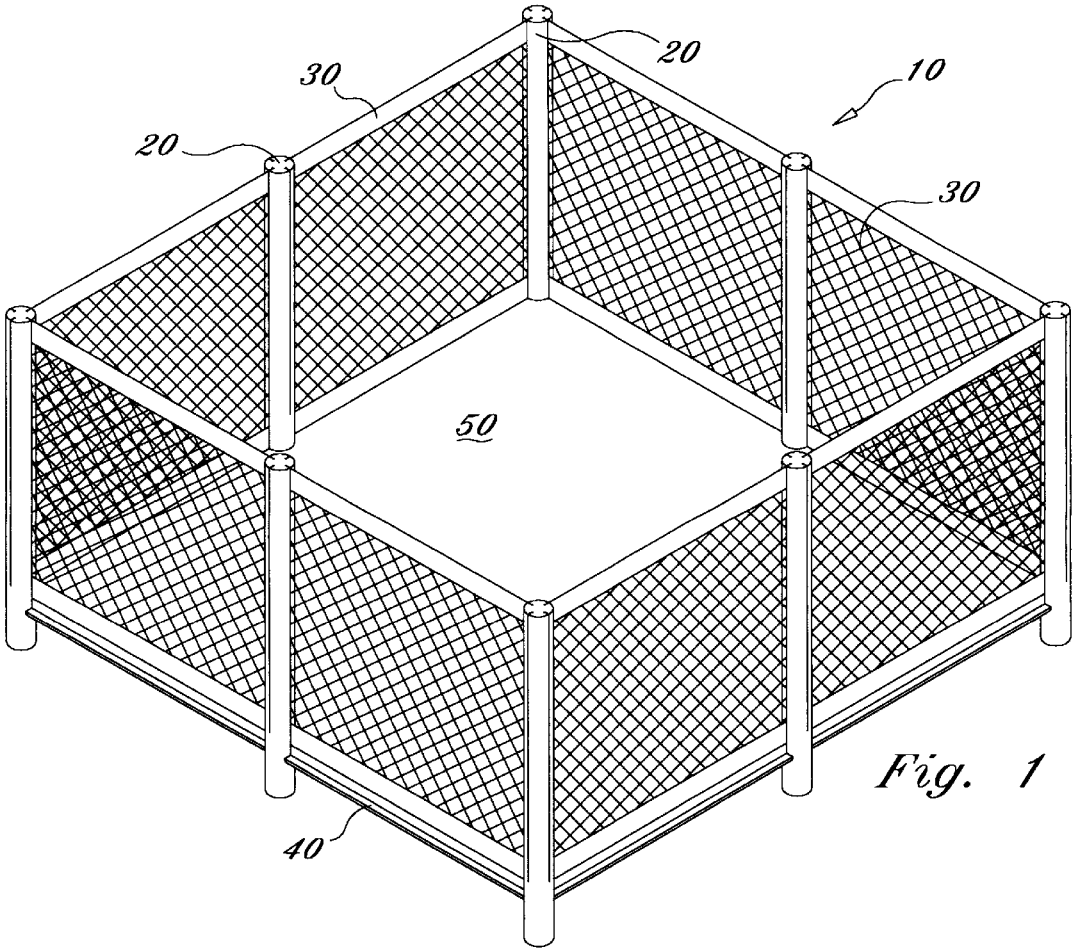
FIG. 1 is a perspective view of the modular playpen 10 of the present invention, showing vertical uprights 20, cross bars 40, side panels 30 and floor pads 50.

Turning now to the drawings, FIG. 1 schematically illustrates the modular playpen apparatus of the present invention, generally referenced as 10. The apparatus includes: a plurality of vertical uprights 20; a series of substantially rectangular side panels 30; a plurality of horizontal cross bars 40; floor pads 50 and a center support post 60 underneath the floor pads (shown in FIG. 6).

Figure 2:
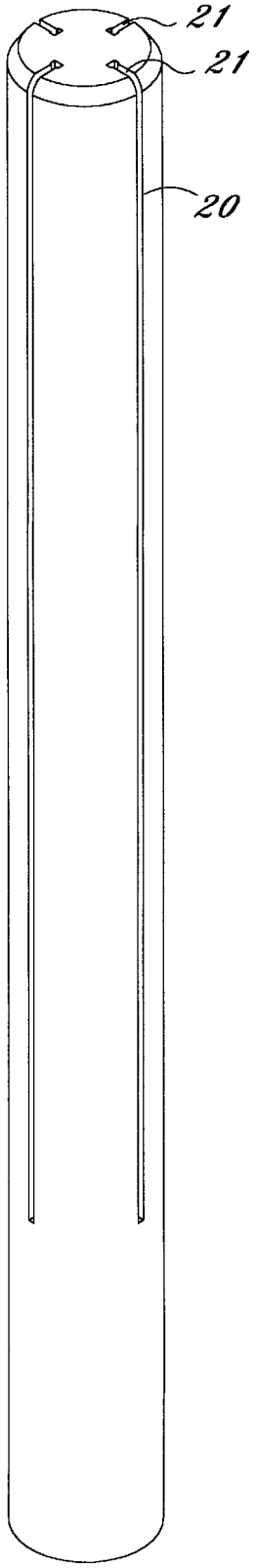
FIG. 2 shows a perspective view of a vertical upright 20 with a groove 21 running down its length.

Referring specifically to FIG. 1, vertical uprights 20 are positioned a sufficient distance from each other in order to allow for a side panel 30 to fit between them. Each upright 20 is a round post comprised of plastic or other suitable material, approximately 2 feet high. Each upright 20 has a slot or groove 21 running along its length. This can be seen more clearly in FIG. 2 and FIG. 3. The vertical side of each side panel 30 slides into one of the grooves 21 of a vertical upright 20. Each upright 20 is joined to two side panels 30 to form the enclosure shown in FIG. 1.

Although the playpen 10 can be configured as a square, as shown in FIG. 1, there are an infinite number of configurations that can be formed by either matching different grooves 21 of different uprights 20 with different side panels 30 or by adding on additional panels 30, uprights 20 and cross bars 40. Each upright 20 has four identical grooves 21 running along its length, in order to receive up to four side panels 30. In an alternate embodiment, each upright 20 can have more than four grooves. This would allow for connection to more side panels 30 and cross bars 40 thereby creating many more playpen configurations.

Each horizontal cross bar 40 is of approximately the same length as each side panel 30 and provides structural support to the bottom, horizontal side of each side panel 30. Each end of the horizontal cross bar 40 is inserted into a vertical upright 20, just below the bottom of groove 21.

Figure 3:
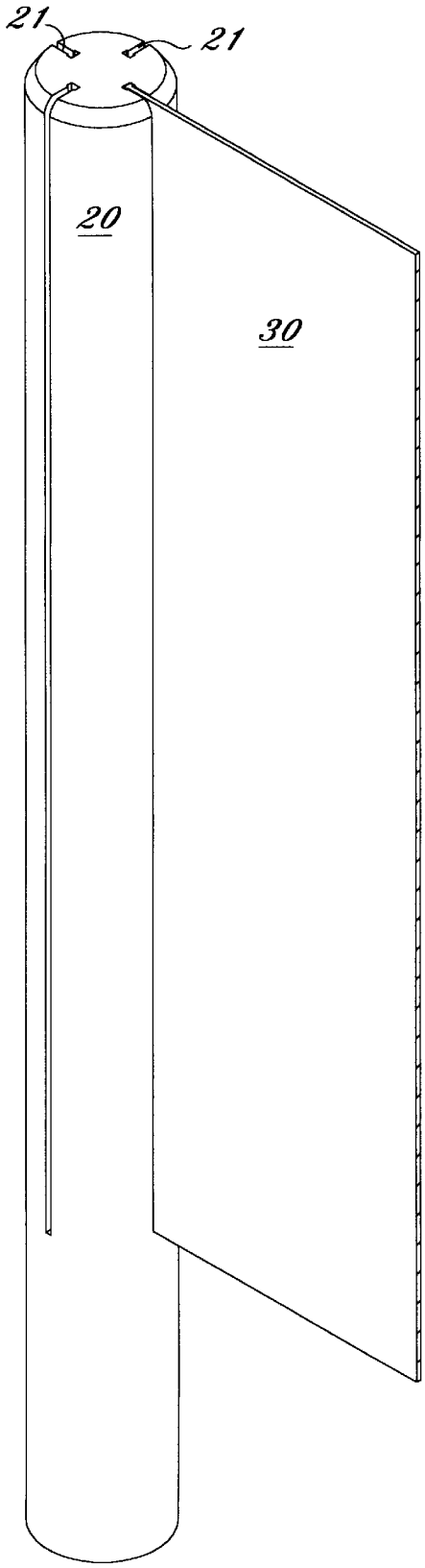
FIG. 3 shows a perspective view of a side panel 30 removably connected to a vertical upright 20 via said groove 21.

FIG. 3 shows the inter-connection of a side panel 30 with a vertical upright 20. The groove 21 running down the length of the vertical upright 20 is approximately ½-inch deep and sized to receive a vertical edge of a side panel 30. The groove 21 does not extend the entire length of the upright 20 but terminates near the bottom to allow for the cross bar 40 to be inserted into the upright 20.

Figure 4:
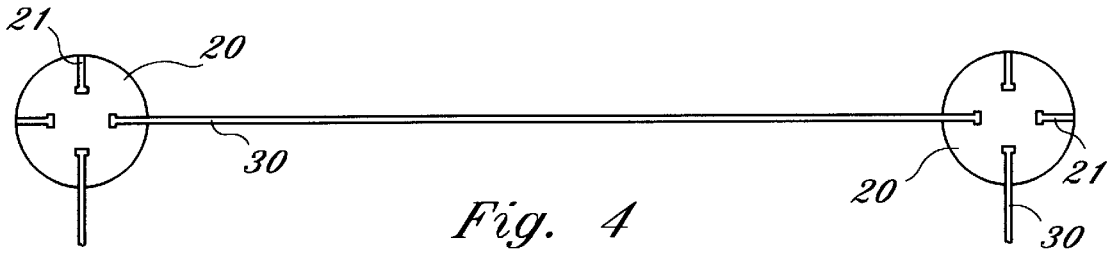
FIG. 4 shows a top view of the side panel-vertical upright connection.

In the preferred embodiment, the groove 21 begins at the top of the vertical upright 20 and terminates near the bottom of the vertical upright 20, above where the cross bar 40 meets the upright 20. FIG. 4 shows a top view of the upright-side panel connection. Two side panels 30 can be slid from the top of an upright 20 within one of the grooves 21. The length of the groove 21 corresponds to the length of each side of a side panel 30 allowing for each vertical side of a side panel 30 to be slidably secured to an upright 20.

Figure 6:
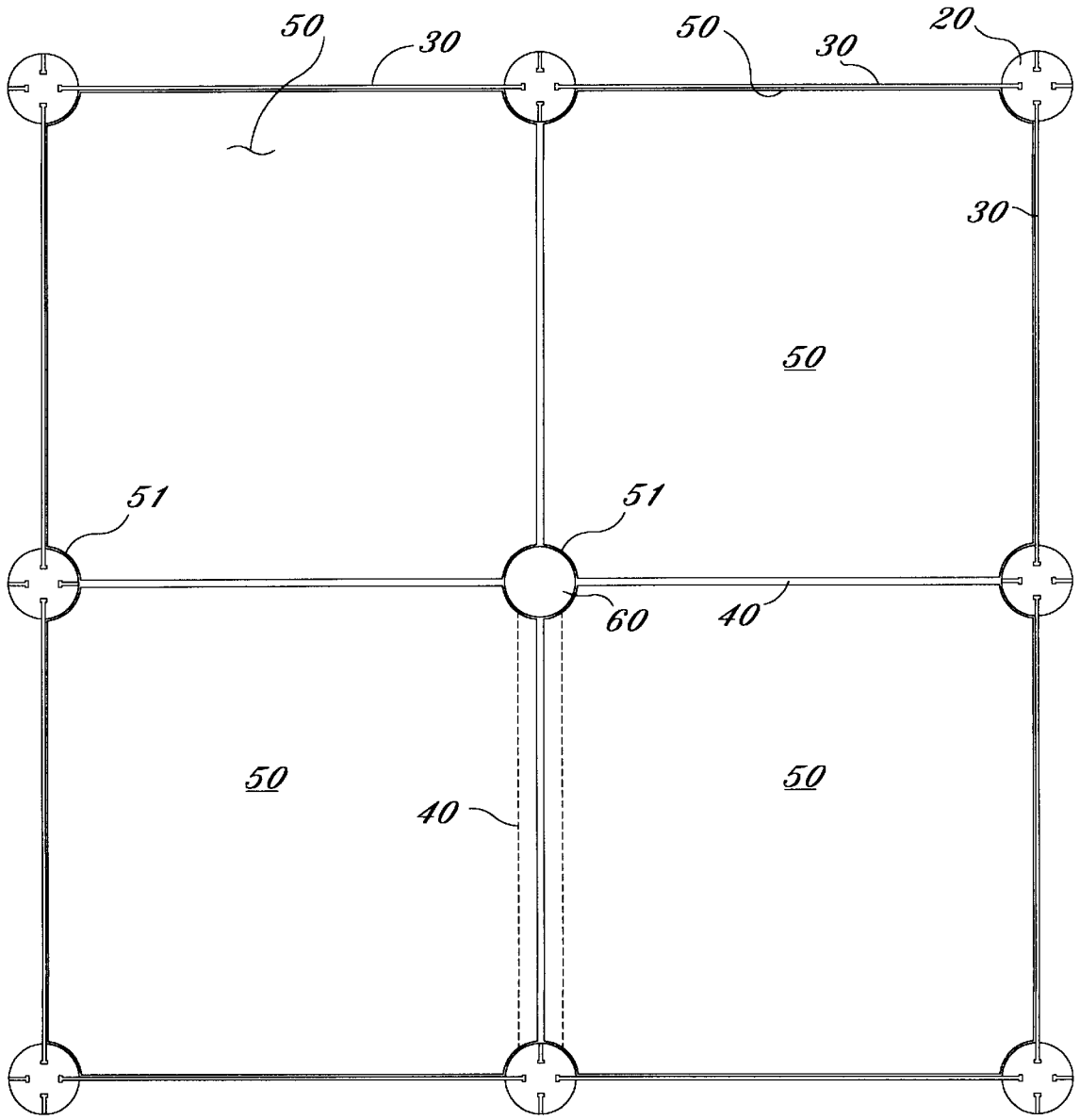
FIG. 6 shows a top view of the playpen 10 of FIG. 1.

FIG. 6 depicts a top view of the square-shaped playpen 10 of FIG. 1 and shows the interconnection of the side panels 30 with the grooves 21 in each vertical upright 20. Also shown is the center post 60 as it protrudes through and between the floor pads 50. The cut-outs 51 in each corner of the floor pads 50 allow for the center post 60 to protrude between the pads thereby providing a contiguous inner surface. The top covering of the center post 60 is comprised of the same material that comprises the floor pad 50. In this way, the floor of the playpen 10 forms a uniform surface.

The actual inter-connection of the panel and upright can occur in a variety of ways. One method can be to provide a notch or downward protrusion in the bottom of the edge of the side panel 30. This protrusion would be inserted into the upright 20 first until the protrusion reaches the terminus of the groove 21. The remaining portion of the edge of the panel 30 can then slide into the remaining portion of the groove 21 until the panel 30 is secured therein. Other methods to connect the panels 30 to the uprights 20 may include providing panels with a spring mechanism on one or both ends, a small horizontal flange on the top corner of the panel preventing the panel from dropping down into the groove, or a retractable knob similar to those used to secure accordion closet doors within closet enclosures, located at the bottom corner of each panel used in conjunction with the flange.

Each side panel 30 is substantially rectangular or square. Its sides are generally of plastic and surround a see-through nylon mesh or netting made of standard nylon material. This allows for the young child or infant within the playpen enclosure to observe the events outside of the playpen. Each side panel 30 can be easily removed by lifting it up and out of the groove 21 of the vertical uprights 20. No tools are necessary. The easy removal of the side panels 30 does not belie the fact that the panel-upright connection is sturdy and a young child within the enclosure could not remove a panel by himself.

Figure 5:
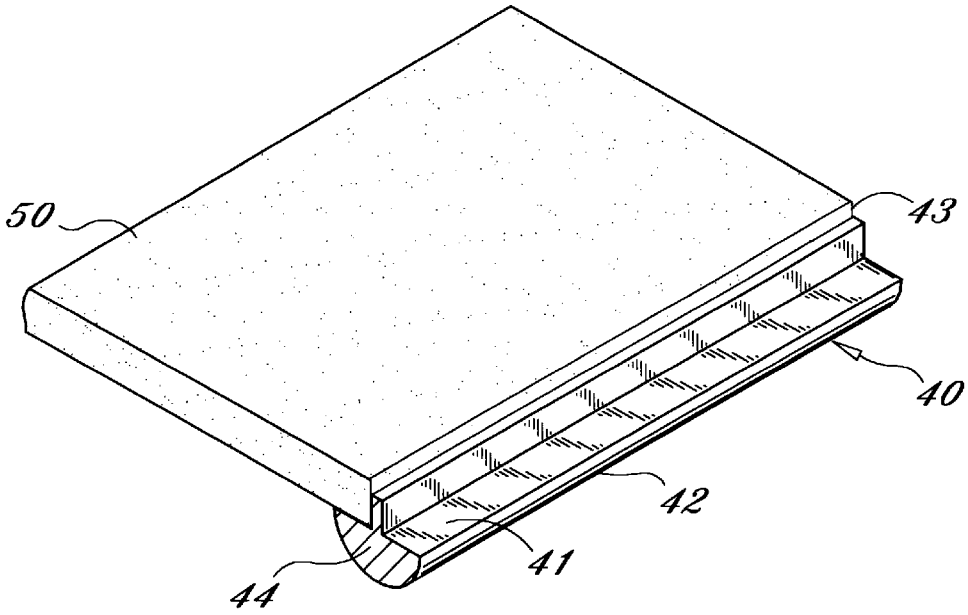
FIG. 5 shows a perspective view of the cross bar 40 and a floor pad 50 being supported by the ledge of the upper side of the cross bar 40.

FIG. 5 shows the horizontal cross bar 40 of the present invention in greater detail. Each horizontal cross bar 40 has a flat upper longitudinal surface 41 and a rounded lower longitudinal surface 42. The flat upper longitudinal surface 41 has a thin protruding edge 43 running along its entire length. This edge 43 bisects the flat upper longitudinal surface 41, thereby creating an inner and outer upper longitudinal surface. As can be seen clearly in FIG. 5, the inner portion of the upper longitudinal surface 41 provides support to the outer edge of the floor pad 50. For safety and aesthetic purposes, the top of the edge 43 remains below the top surface of the floor pad 50 thereby preventing the appearance of the edge within the interior of the playpen 10. The lower horizontal side of the side panel 30 rests on top of the protruding edge 43.

Each floor pad 50 is made of a sturdy plastic backing material topped by a vinyl-covered cushion, such as polyurethane foam. To accommodate the vertical uprights 20, the floor pads 50 have an arc-shaped cut-out 51 at each of its corners. Therefore, when a floor pad 50 abuts against an upright 20 or center post 60, a contiguous surface is created, and the pads do not overlap.

FIG. 6 shows a top view of the square playpen 10 of FIG. 1. The cut-outs 51 can be seen wherever a floor pad 50 is positioned next to an upright 20 or center post 60. These cut-outs 51 allow for the floor pads 50 to fit snugly within the enclosure without any spaces which may cause injury to the child. The floor pads 50 are sized such that each pad will fit snugly between the vertical uprights 20 and the protruding center post 60.

Each vertical upright 20 receives an end of a cross bar 40. In the preferred embodiment, each upright 20 has a notch of approximately the same shape as the t-shaped end 44 of cross bar 40, below the terminus of groove 21 to receive one end of the cross bar 40. However, other connection means may be employed to join the upright and cross bar.

Figure 7:
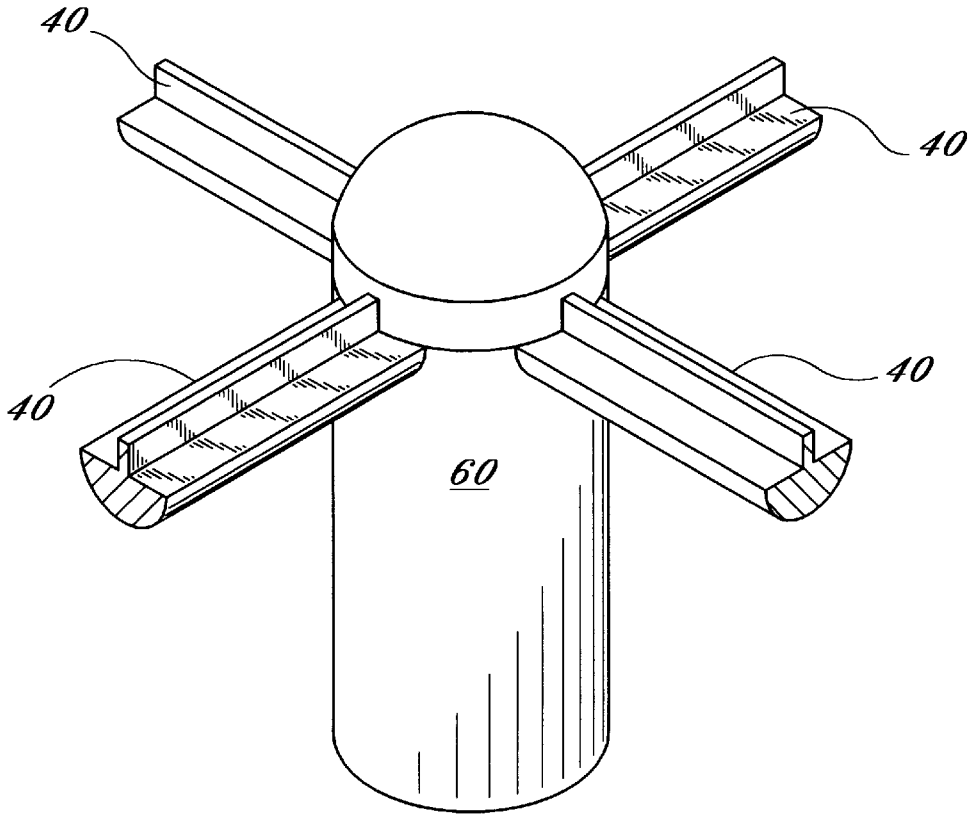
FIG. 7 shows a perspective view of the center post 60 connected to four cross bars 40.

FIG. 7 shows the center post 60 and its connection to four horizontal cross bars 40. The center support post 60 is positioned substantially underneath the floor pads 50, within the interior of the playpen 10. The top portion of the center post 60 is covered with the same vinyl cushion material as that of the floor pads and protrudes up and between the void created by the cut-outs 51. The four horizontal cross bars 40 connect to the center support post 60 via the same means as the cross bars 40 are connected to the uprights 20 around the perimeter of the playpen 10, namely, the insertion of the t-shaped end 44 of the cross bar 40 into a notch in the center support post 60. Once again, other standard connecting means could be employed. The center post 60, therefore, receives one end of the four cross bars 40, and the four centermost uprights 20 around the perimeter of the playpen 10 receive the other end of the cross bar 40. FIG. 6 shows the four (4) centermost uprights around the perimeter of the playpen 10 receiving three (3) horizontal cross bars 40 each, (two along the perimeter of the playpen and a third underneath the floor pads 50), while the four (4) corner uprights receive two (2) horizontal cross bars 40. FIG. 6 also shows the cut-outs 51 of the floor pads 50 allowing for the center post 60 to protrude between the floor pads 50.

The center support post 60, in conjunction with the cross bars 40, does not support the side panels 30, but instead serves to provide support to the playpen 10 from underneath the floor pads 50 while forming a connection between the sides of the playpen 10. The center post 60 is not noticeably discernable as only its top protrudes between the pads and it is made of the same material as the floor pads.

In the preferred embodiment of the present invention, a total of eight uprights 20, eight side panels 30, four floor pads 50, twelve cross bars 40 and one center support post 60 are used to create a square playpen enclosure, approximately 3 feet by 3 feet. However, as can be seen in FIGS. 8–11, the components can also be reconfigured to produce an approximately 4½ foot by 1½ foot rectangular enclosure, or other non-conventional configurations, to conform to the contour of different sized rooms or area constraints.

Figure 8:
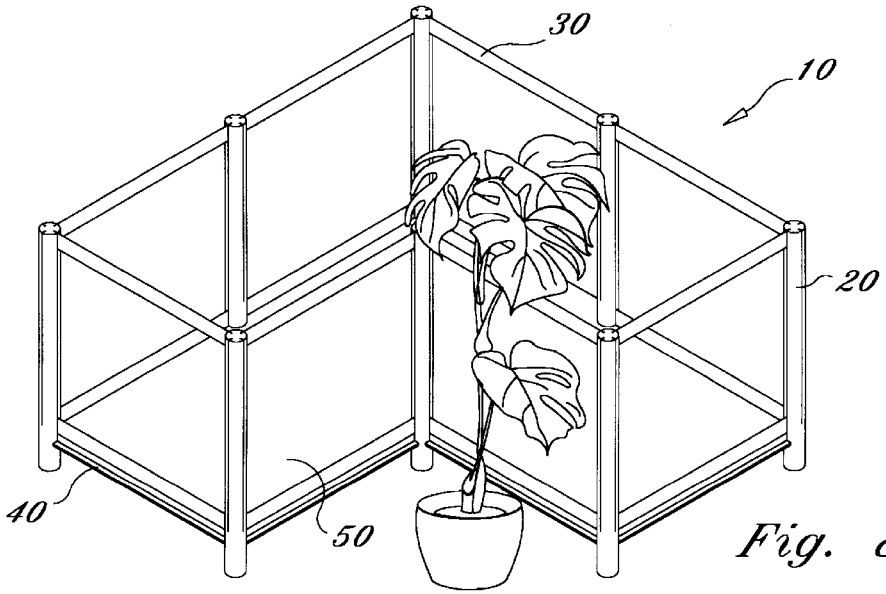
FIG. 8 shows an alternate configuration of the present invention.
Figure 9:
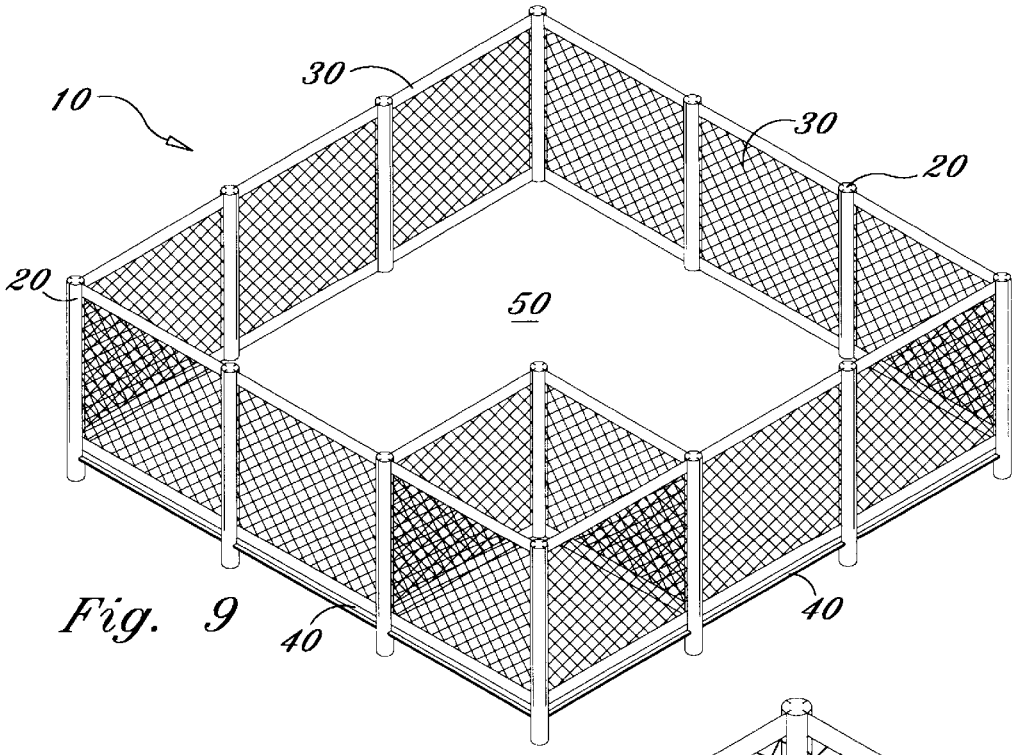
FIG. 9 shows yet another configuration of the present invention.
Figure 10:
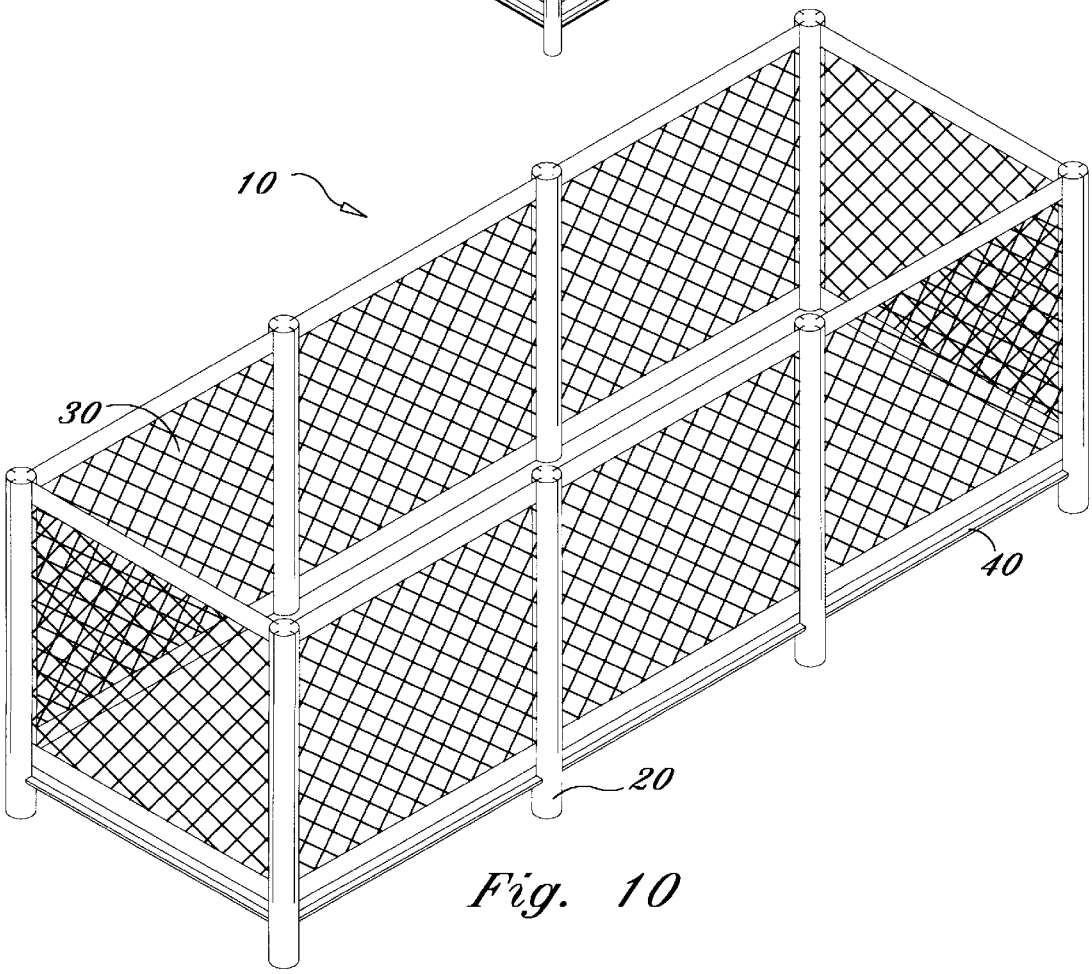
FIG. 10 is a rectangular configuration of the present invention.
Figure 11:
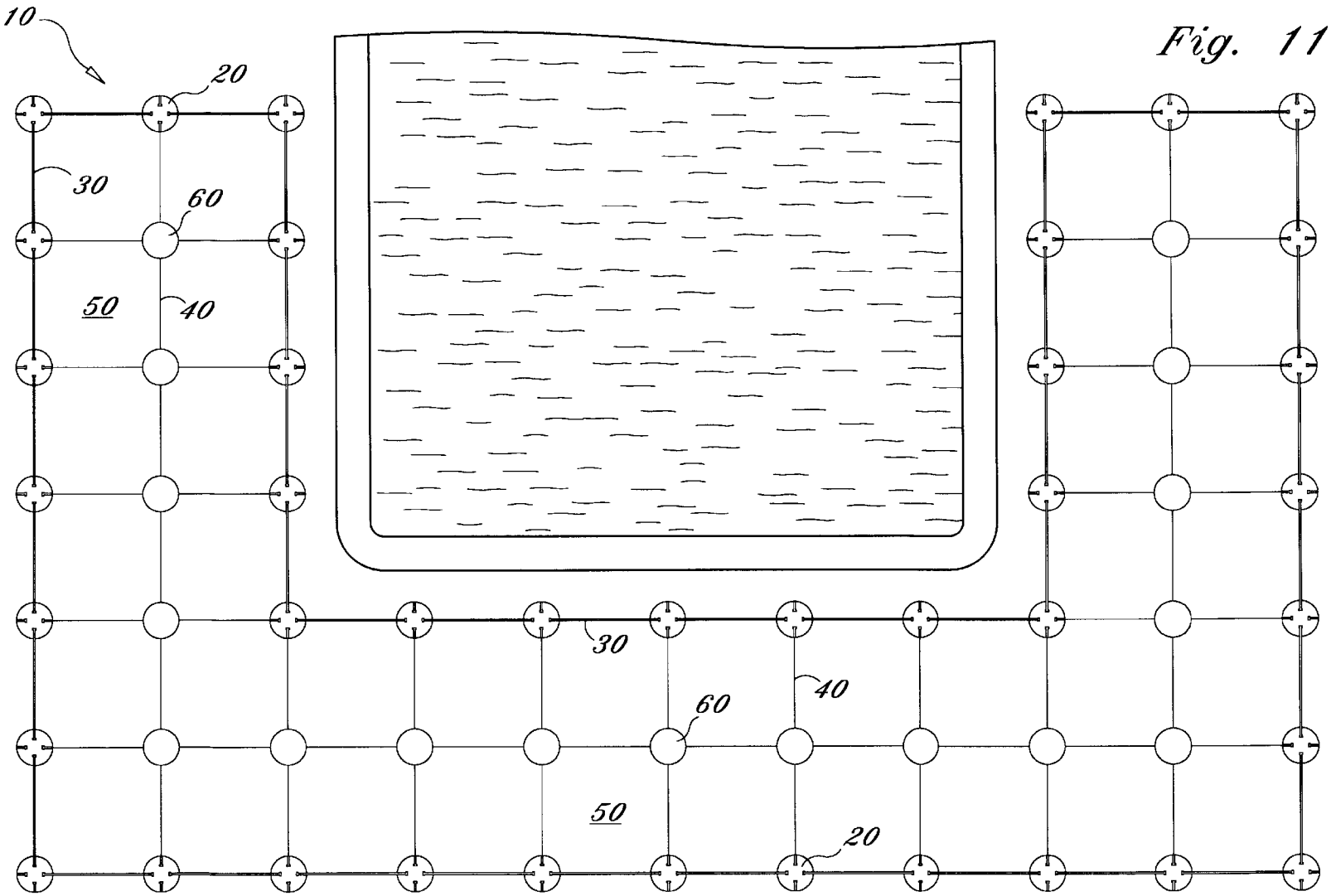
FIG. 11 shows a top view of the playpen 10 configured around the perimeter of a pool.

Additional side panels, uprights and cross bars can be added to expand and alter the shape of the enclosure to adapt to available space. As shown in FIG. 8, the playpen 10 can be configured around objects in the room. As seen in FIG. 9, side panels 30 can be inserted into the uprights 20 to create separate enclosures. The need for a separate enclosure may be for a sleeping child who needs to be separated from the other children, or to store children's shoes or extra clothing while the child plays in the larger, adjacent enclosure. A long, rectangular version of the playpen 10 may be used to near a pool, as seen in FIG. 11. For example, if others are in the pool, and there is not sufficient space to fit a standard playpen, the playpen 10 of the present invention can be configured to "wrap around" and follow the perimeter of the pool. This would allow the child to remain safely in the playpen, yet follow the activity in the pool. With a small amount of creativity, parents can create a variety of entertaining and practical configurations of the playpen 10.

The present invention could be used in various rooms in the home, outside in the backyard, in day-care centers, or taken on trips. The ease at which the side panels can be slid out of the elongated grooves along the length of the uprights make the present invention easy to disassemble and reassemble without the use of tools. Furthermore, the horizontal cross bars can be removed from the vertical uprights with little difficulty. The entire playpen can be disassembled and transported in a travel bag. Further embodiments can offer an attachable covering or canopy if the playpen were to be used outside, in inclement weather.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A modular playpen comprising:

a plurality of vertical uprights having a central longitudinal portion, each said vertical upright having a plurality of engaging means disposed about its exterior surface;

a plurality of substantially rectangular side panels having opposing horizontal and vertical sides, slidably engaged to said plurality of vertical uprights via said engaging means thereby forming an enclosure of sufficient size to accommodate a child, each said panel is removably engaged to said uprights thereby allowing said side panels to be removed and relocated to form a variety of possible playpen configurations;

a plurality of cross bars disposed substantially horizontally and tangentially within the interior of said playpen wherein one end of each said cross bar is removably engaged to one of said vertical uprights to provide stability to said modular playpen; and one or more floor pads positioned within the interior of said enclosure and supported therein by said cross bars whereby said playpen is sufficiently sturdy to safely protect a child therein and can be reconfigured to a variety of different shapes to accommodate space constraints, without the use of tools or excess effort.

2. The modular playpen of claim 1 wherein each said cross bar comprises:

a flat upper longitudinal surface;

a rounded lower longitudinal surface; and a transverse divider extending substantially vertically from said flat upper longitudinal surface and bisecting said flat longitudinal surface thereby creating an inner and outer flat upper longitudinal surface.

3. The modular playpen of claim 1 wherein said plurality of engaging means comprise grooves extending down said central longitudinal portion of each said vertical upright to receive said vertical side of said side panel.

4. The modular playpen of claim 2 wherein said supporting means comprises a ledge formed by the intersection of said transverse divider and said inner flat upper longitudinal surface such that said ledge provides lateral support for said floor pads.

5. The modular playpen of claim 3 wherein one end of each said cross bar is inserted into said vertical upright below said groove.

6. The modular playpen of claim 1 further comprising a center support post positioned substantially underneath said floor pads and secured therein by engagement to said plurality of said cross bars thereby providing additional stability to said modular playpen and raising said floor pads off the ground.

7. The modular playpen of claim 6 wherein said floor pads comprise cut-outs on each corner of said floor pad wherein said center post protrudes through said cut-outs thereby providing a flush, contiguous interface between said floor pad, said vertical uprights and said center post.

8. The modular playpen of claim 1 wherein each said side panel is identical to each other said side panel thereby allowing for interchangeability of side panels.

9. The modular playpen of claim 1 wherein each said vertical upright is identical to each other said vertical upright thereby allowing for interchangeability of vertical uprights.

10. The modular playpen of claim 1 wherein each said cross bar is identical to each other said cross bar thereby allowing for interchangeability of cross bars.

11. A modular playpen comprising:

a plurality of vertical uprights having a central longitudinal portion;

a plurality of substantially rectangular side panels having opposing horizontal and vertical sides, slidably affixed to said plurality of vertical uprights via affixing means thereby forming an enclosure of sufficient size to accommodate a child wherein each said side panel is identical to each other said side panel thereby allowing for interchangeability of side panels;

said affixing means comprise a groove extending down said central longitudinal portion of said vertical upright which receives said vertical side of said side panel;

each said vertical upright has a plurality of said grooves extending down said longitudinal portion of said vertical upright allowing for removable engagement with said side panels thereby allowing said playpen to be reconfigured in a variety of ways;

one or more floor pads positioned within the interior of said enclosure and supported therein by supporting means whereby said playpen is sufficiently sturdy to safely protect a child therein and can be reconfigured to a variety of different shapes to accommodate space constraints, without the use of tools or excess effort;

a center support post positioned substantially underneath said floor pads and secured therein by engagement to a plurality of said cross bars thereby providing additional stability to said modular playpen and raising said floor pads off the ground;

a plurality of cut-outs on each corner of said floor pad wherein said center post protrudes through said cut-outs thereby providing a flush, contiguous interface between said floor pad, said vertical uprights and said center post;

said supporting means comprise a ledge joined by the intersection of said transverse divider and said inner flat upper longitudinal surface such that said ledge provides lateral support for said floor pads;

a plurality of cross bars positioned horizontally between said vertical uprights to provide stability to said modular playpen wherein each end of said cross bar is removably engaged to one of said vertical uprights immediately below said groove;

each said vertical upright is identical to each other said vertical upright thereby allowing for interchangeability of vertical uprights; and said cross bar is identical to each other said cross bar thereby allowing for interchangeability of dross bars, and wherein said cross bar comprises:

a flat upper longitudinal surface a rounded lower longitudinal surface; and a transverse divider extending tangentially from said flat upper longitudinal surface and bisecting said flat longitudinal surface thereby creating an inner and outer flat upper longitudinal surface.

12. A modular playpen comprising:

a plurality of vertical uprights having a central longitudinal portion;

a plurality of substantially rectangular side panels having opposing horizontal and vertical sides, slidably affixed to said plurality of vertical uprights via affixing means thereby forming an enclosure of sufficient size to accommodate a child;

a plurality of cross bars positioned horizontally between said vertical uprights wherein each end of said cross bar is removably engaged to one of said vertical uprights to provide stability to said modular playpen;

one or more floor pads positioned within the interior of said enclosure and supported therein by supporting means whereby said playpen is sufficiently sturdy to safely protect a child therein and can be reconfigured to a variety of different shapes to accommodate space constraints, without the use of tools or excess effort;

a center support post positioned substantially underneath said floor pads and secured therein by engagement to said plurality of said cross bars thereby providing additional stability to said modular playpen and raising said floor pads off the ground; and said floor pads comprise cut-outs on each corner of said floor pad wherein said center post protrudes through said cut-outs thereby providing a flush, contiguous interface between said floor pad, said vertical uprights and said center post.

* * * * *